US005156478A

United States Patent [19]

Jobs

[11] Patent Number: 5,156,478

[45] Date of Patent: Oct. 20, 1992

[54] DEVICE FOR SETTING OPERATING PARAMETERS OF A PRINTER AS A FUNCTION OF THE PRINT HEAD POSITION

[75] Inventor: Günter Jobs, Nersingen-Strass, Fed. Rep. of Germany

[73] Assignee: Mannesmann Aktiengesellschaft, Düsseldorf, Fed. Rep. of Germany

[21] Appl. No.: 580,638

[22] Filed: Sep. 10, 1990

[30] Foreign Application Priority Data

Sep. 11, 1989 [DE] Fed. Rep. of Germany ..... 3930677

[51] Int. Cl.[5] ..... B41J 29/42

[52] U.S. Cl. ..... 400/705; 400/279; 400/477

[58] Field of Search ..... 400/83, 64, 320, 477, 400/703, 705

[56] References Cited

U.S. PATENT DOCUMENTS 4,722,621 2/1988 Johnson ..... 400/472
4,827,282 5/1989 Ritchie ..... 400/320
4,846,597 7/1989 Bryant et al. ..... 400/83
4,856,924 8/1989 Sugino ..... 400/703

*Primary Examiner*—Clifford D. Crowder
*Assistant Examiner*—John S. Hilten
*Attorney, Agent, or Firm*—Horst M. Kasper

[57] ABSTRACT

The position of a print head, movable back and forth over the width of a paper band, is used as an index versus parameter data in menu presentation recorded parallel to the extension of the print-head motion path in a device for the setting of operating parameters of a printer. In order to eliminate a conventional continuous and repeated printing of the operating parameters on paper, a new setting of the programming at the printer can be performed such that the operating parameters (3) are visually displayed in form of a permanent or callable display (4) at the casing (5) of the printer. A position-determining element (6) is furnished at the print head (1). The momentary position indicator (7) of the print head (1) is reproduced on the display (4) for the operating parameters (3), as illustrated in FIG. 4.

20 Claims, 7 Drawing Sheets

10
2
7
6
1
PRINT HEAD
6
POSITION DETERMINING ELEMENT
11
PRINT HEAD DRIVE
12
17
23
CONTROL UNIT
20
MICROPROCESSOR
14
ROTA-RY SWIT-CH
ADD KEY
15
24
DATA BUS
25
ADDRESS BUS
26
21
CONTROL PROGRAM
WRITE PROTECTED
FUNCTION/PROGRAM STORAGE
NONVOLATILE READ/WRITE STORAGE
22

DEVICE FOR SETTING OPERATING PARAMETERS OF A PRINTER AS A FUNCTION OF THE PRINT HEAD POSITION

BACKGROUND OF THE INVENTION

1. Field of the Invention

The invention relates to a device for the setting of operating parameters of a printer, in particular of a matrix printer, with a print head moving back and forth over the width of the paper band, where the position of the print head can serve as an index versus parameter data presented in a menu arrangement and recorded in parallel to the extension of the print-head motion path, which parameter data can be permanently programmed in each case by way of release elements disposed on an operating board.

2. Brief Description of the Background of the Invention Including Prior Art

Such devices for the setting of operating parameters of a printer serve the user for the setting of frequently used functions as well as operating base settings, such as, for example paper feed method,
paper advance,
print quality (draft, near-letter-quality, letter-quality),
representation of characters (fonts) and character sets,
line and paper format,
print operations.

The user is thereby enabled to take advantage of all possible properties of the printer.

The initially recited device is known from the German Patent DE-Cl-3,324,424. The conventional arrangement refers to a method for the setting of fixed and permanent operating parameters and/or of operating parameters selected from a group of operating parameters such as print quality, character set, character size and print format, fonts, input for the control of the print operation during different modes of operation such as in connection with BTX use and electronic data processing use. The operating parameters can be selectively stored in a function memory storage and they are called individually for the purpose of the programming of the main memory storage and are printed line by line. The operator selects the operating parameter to be transferred into the main memory storage. For this purpose, a plurality of print lines are to be printed successively one below the other in case of a group of operating parameters of the same kind. If therefore the user wants to change the operating parameters, he has to print these out in each case. Not only does the requirement of paper use for the programming become very high based on this method and requirement, but in addition an already initiated editing and processing of a text is interrupted. Serial output mediae such as matrix printers, ink-jet printers, thermal printers, daisy-wheel printers and the like contain a plurality of functions which are preset or which are manually changed during operation for the operating of the apparatus via multi-function keys on an operator board, via so-called DIP switches, or via menu print-out. These settings require an increasing amount of knowledge about the specific apparatus. They consume time and are generally hard to comprehend and to handle by the non-professional user.

SUMMARY OF THE INVENTION

1. Purposes of the Invention

It is an object of the present invention to improve the arrangement for a setting of operating parameters of printers such that, without any print-out requirement of the operating parameter menu, a resetting of the programming can occur at a printer.

It is a further object of the present invention to provide a method by which the setting of the parameters of a printer can be performed easily, accurately, and reliably.

It is yet a further object of the present invention to provide a method which simplifies the use of a matrix and other printers.

These and other objects and advantages of the present invention will become evident from the description which follows.

2. Brief Description of the Invention

The present invention provides for a device for a setting of operating parameters of a printer, in particular of a matrix printer. A menu display is surrounded by a casing of the printer. The operating parameters of the printer are visually displayed on the display. An operator board is provided with release elements. Parameter data are in each case permanently programmable by way of release elements of the operator board. A print head is movable back and forth over the width of a paper band. The position of the print head serves as an index versus parameter data in the menu display recorded parallel to the extension of the print-head motion path. A position-determining element is provided at the print head delivering a position signal. A momentary position value is reproduced on the display for the operating parameter.

The display can be text-display scale. The operating parameter can be applied in form of indexes coordinated and insertable into the text-display scale. The print head can be furnished with a sensor for recognizing the momentary position of the indexes.

The sensor is a position sensor. For the purposes of this document, a position sensor can be a contactless operating sensor, an inductive sensor, a capacitive sensor, or an opto-electronic sensor.

The display can comprise a visual display. The display can be represented by an exchangeable text-display scale.

A position device can serve as the position-determining element. The position indicator can be made of a light element on the display.

A print-head drive controllable via a rotary switch can be disposed on the operator board. Said rotary switch can generate phase-related switching pulses depending on the rotation direction. The phase-related switching pulses can be evaluated both with respect to the rotation direction as well as with respect to the rotary angle and the rotation speed. The rotary switch can be formed by an action switch.

A fine positioning means for the position-determining element can be adjustable by way of an additional key on the operator board and, simultaneously, a programming can be performed of the operating parameters displayed on the display.

The operating parameters are visually displayed in a permanent or callable display at the casing of the printer. Furthermore, a position-determining element is furnished at the print head, where the momentary position indicator of the print head can be reproduced on the display for the operating parameters. This arrangement allows the user and operator to call up the existing programming immediately after switching on of the printer or, alternatively, to look at the operating parameter menu in order to perform a new programming. To do this, the present invention apparatus does not require any paper nor any actuation of the print mechanism of the printer. In addition to the clear text of the function and of the functional parameters, the visual display can contain markings, and the display can be subdivided into corresponding, logically connected function regions. The subdivision can be selected in this case according to frequency of occurrence and the requirements of programming and can be divided hierarchically into subgroups based on the programming functions. This arrangement allows the user a better overview and a quicker access in order to change the momentarily operating and valid program.

A first embodiment of the invention comprises that the operating parameters are placed in form of indexes, which are coordinated to and insertable on a text-display scale and that the print head is furnished with a sensor or detector for the recognition of the momentary index positions.

According to a further embodiment, the permanent or callable display consists of the text-display scale or of a liquid crystal display.

It is advantageous for different program menus if the text-display scale can be exchanged.

A further improvement of the invention comprises that a path-dependent measurement or counter device serves as a position determining element and that the position indicators on the display comprise an active or passive light element.

Advantageously, the position detector comprises contactless operating, inductive, capacitive, or opto-electronic sensors.

According to a further aspect of the invention, the print-head drive is controllable with a rotary switch, disposed on the operator board. The rotary switch generates, depending on the rotation direction, phase-related switching pulses. These switching pulses can be evaluated both relative to the direction of rotation as well as with respect to the rotary angle and the rotation speed.

According to a further embodiment, the rotary switch is formed by contact switches with a disk with a plurality of contacts furnished by naps, burls, knobs, or by contactless operating sensors, inductive sensors, capacitive sensors or opto-electronic sensors.

The apparatus can further be improved in being able to adjust, by way of an additional key on the operator board, a fine positioning of the position-determining element, and to perform simultaneously a programming of the operating parameter present at the permanent or callable display.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
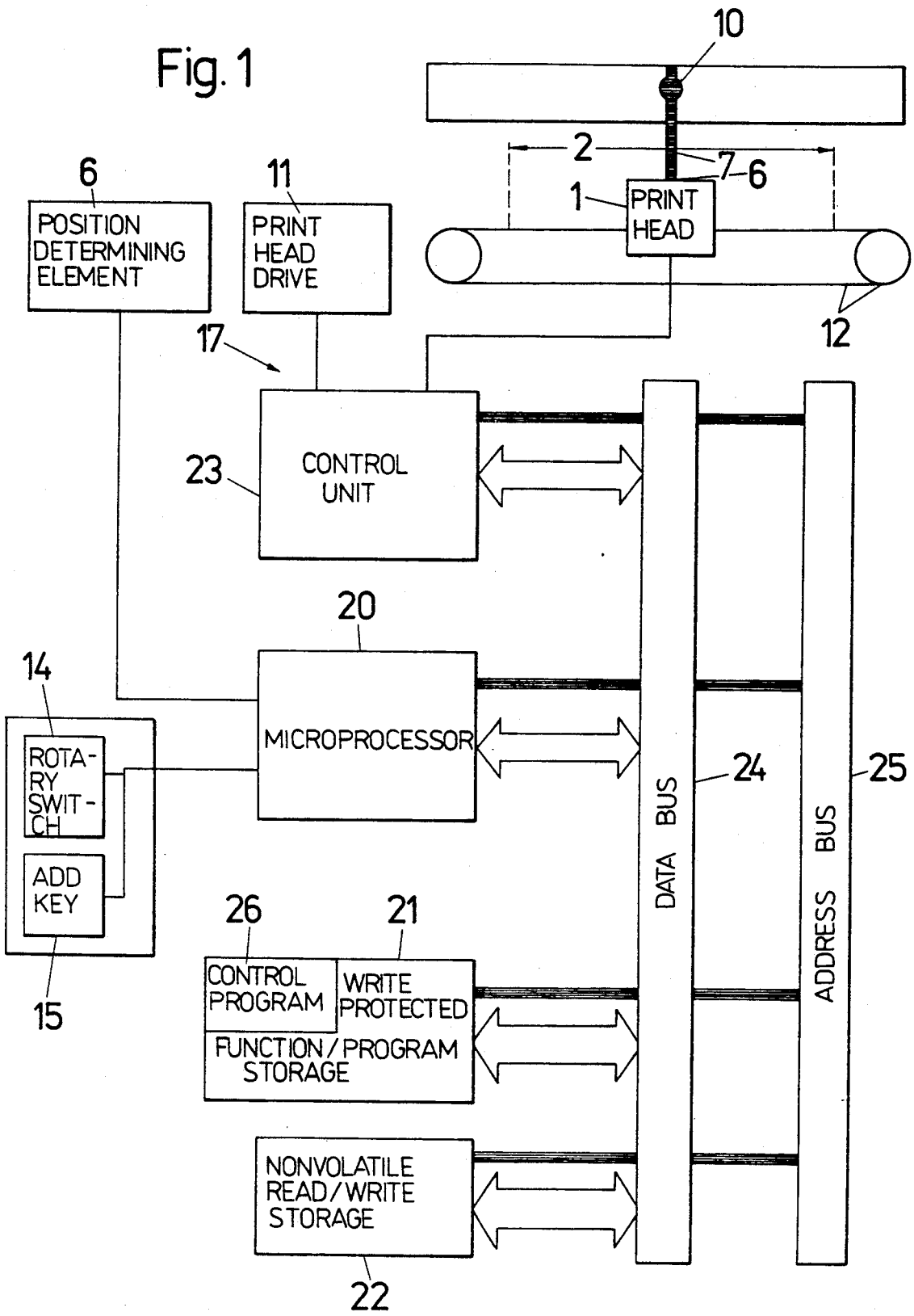
FIG. 1 is a schematic block circuit diagram illustrating the arrangement with text-display scale and rotary switch.

According to the invention there is provided a device for a setting of operating parameters of a printer, in particular of a matrix printer. A print head is movable back and forth over the width of a paper band. The position of the print head serves as an index versus parameter data in a menu display recorded parallel to the extension of the print-head motion path. The parameter data are in each case permanently programmable by way of release elements of an operator board. The operating parameters 3 are visibly displayed in form of a display 4 at a casing 5 of the printer. A position-determining element 6 is provided at the print head 1. A momentary position indicator 7 is reproduced on the display 4 for the operating parameter 3.

The operating parameter 3 can be applied in form of indexes 18, coordinated and insertable in a text-display scale 8. The print head 1 can be furnished with a sensor 28 for recognizing the momentary position of the indexes. The sensor 28 can be a position sensor.

The display 4 can comprises a visual display. The display can be represented by an exchangeable text-display scale 8.

A position device can serve as the position-determining element 6. The position indicator 7 can be made of a light element on the display 4.

A print-head drive 11 can be controllable via a rotary switch 14, disposed on the operator board 13. Said rotary switch 14 can generate phase-related switching pulses depending on the rotation direction. The phase-related switching pulses can be evaluated both with respect to the rotation direction as well as with respect to the rotary angle and the rotation speed. The rotary switch 14 can be formed by an action switch.

A fine positioning of the position-determining element 6 can be adjustable by way of an additional key 15 on the operator board 13 and, simultaneously, a programming can be performed of the operating parameters 3 displayed on the display 4.

The arrangement according to FIG. 1 is set up for a serial matrix printer. A print head 1 is moved back and forth over a print-head motion path 2, which corresponds to the width of the imprintable print substrate. The matrix printer is furnished with an operator board 13, based on which the print head 1 can be controlled. The print head 1 serves in addition to its print function as an index versus parameter data furnished in a menu arrangement and recorded in parallel to the extension of the print-head motion path 2. The operating parameters 3, corresponding to the index of the print head 1, can in each case be permanently programmed by way of release elements such as, for example, the keys 15 of the operator board 13, compare FIGS. 3 and 4.

Figure 4:
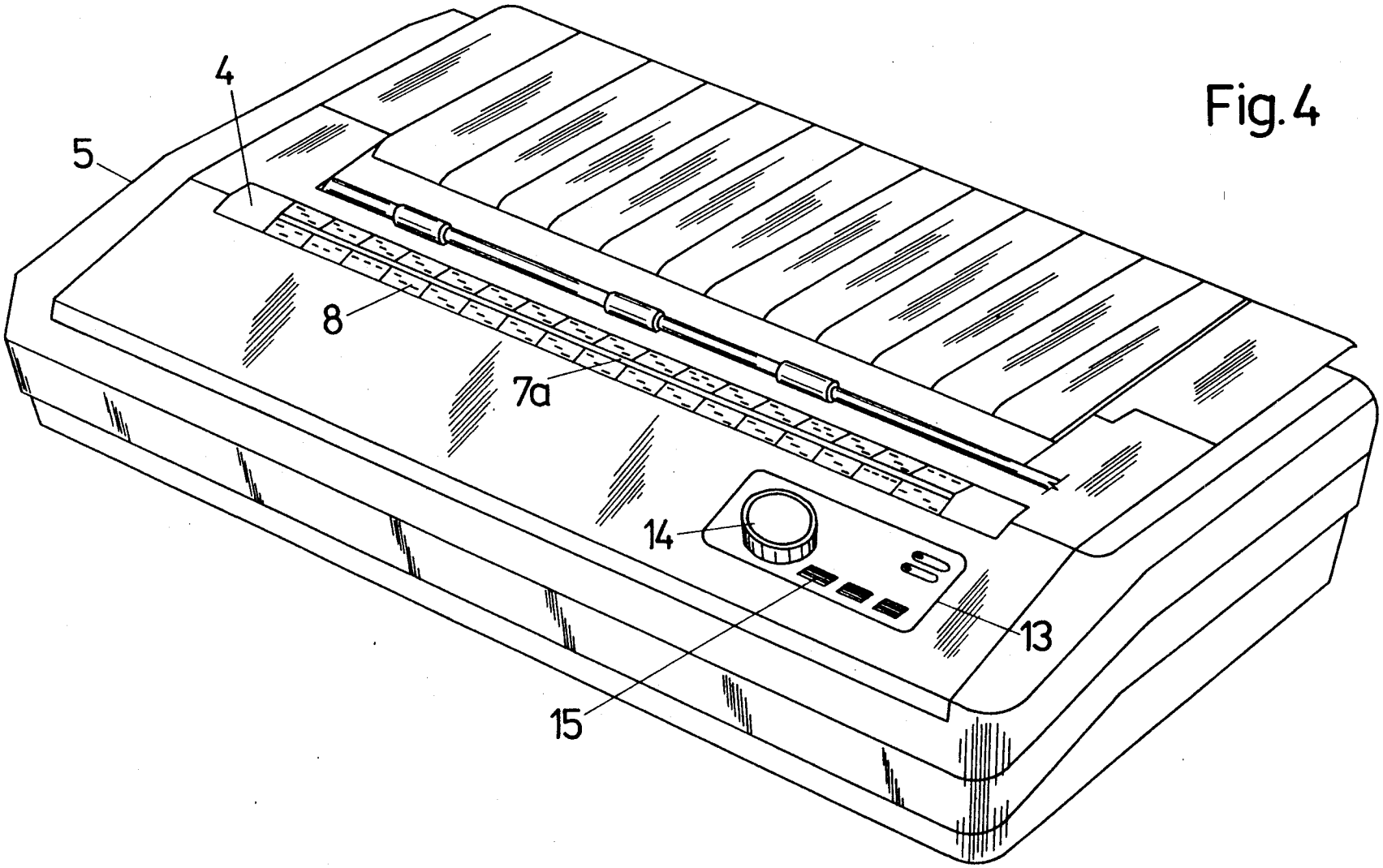
FIG. 4 is a view of the set-up of a printer with a text-display scale and rotary switch.
Figure 5:
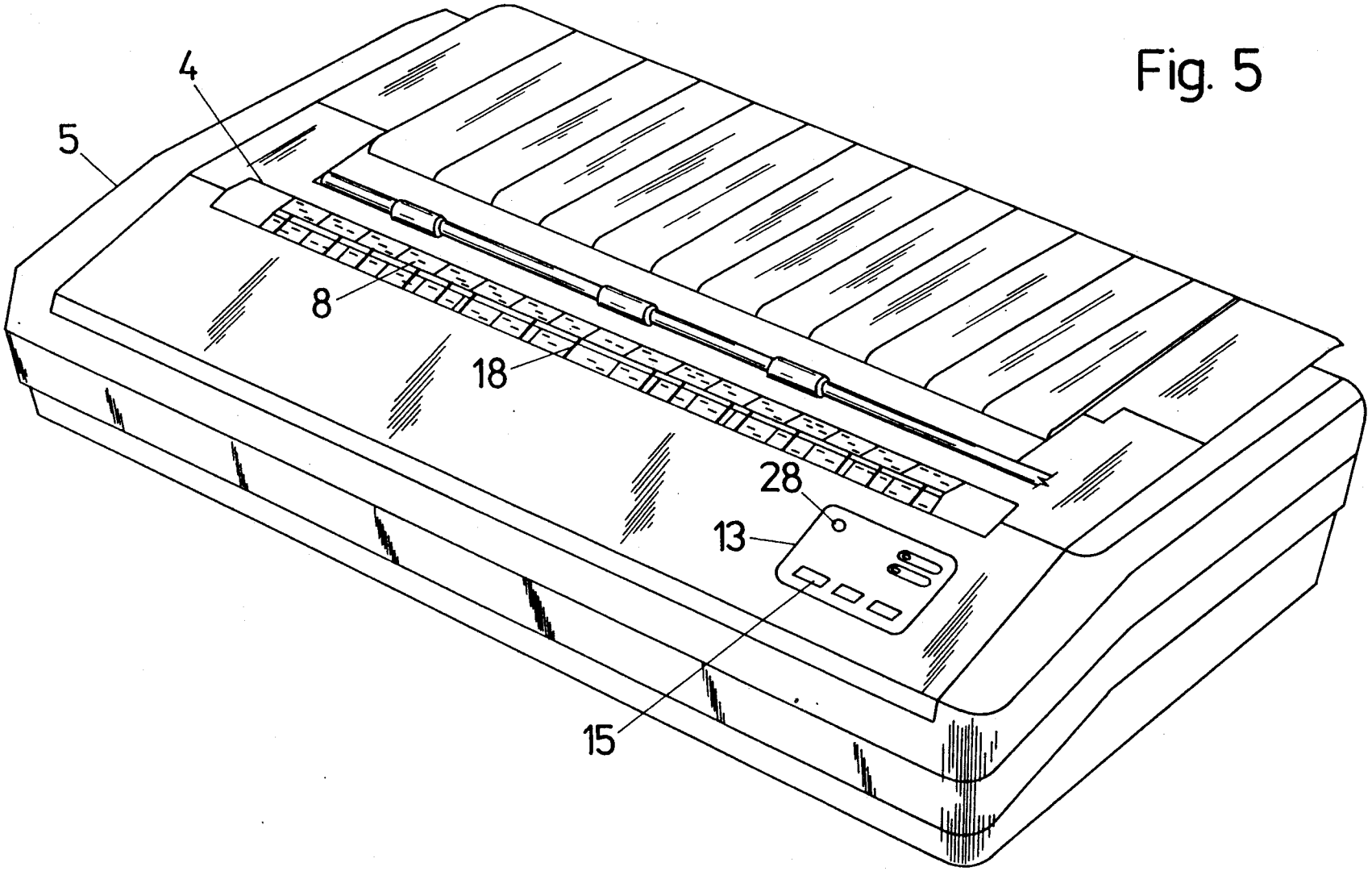
FIG. 5 is a view of the set-up of a printer with a text-display scale and indexes.
Figure 6:
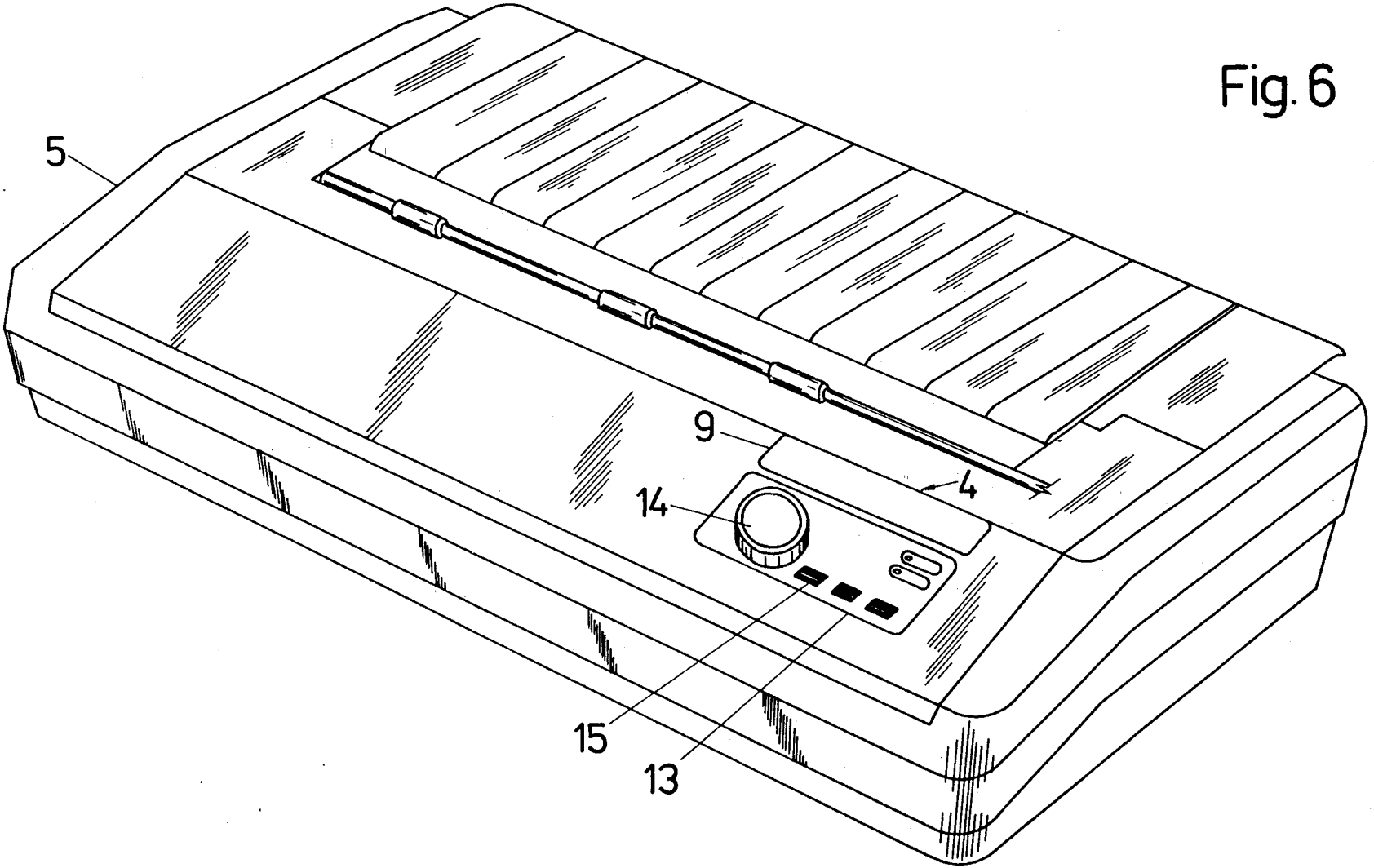
FIG. 6 is a view of the set-up of a printer with a liquid crystal display and rotary switch.

The operating parameters 3 are disposed in form of a permanently visual display or in form of a callable display 4 at the casing 5 of the printer. A position-determining element 6 with a position indicator 7 is provided at the print head 1. An analog position indicator 7*a* can be represented on the display 4. For this purpose, the permanent or the callable display 4 can comprise a pre-printed text-display scale 8, as illustrated in FIGS. 4 and 5, or can comprise a liquid crystal display 9, as illustrated in FIG. 6.

The position-determining element 6 can be a path-dependent measurement device insofar as such a measurement device is already present based on the digital system of an operating cycle disk for the operating of the print elements or based on the operating cycles of the driving step motor. The position indicator 7 on the display 4 can be formed, for example, by a light dot 10, which is generated by an active or passive light element.

A print-head drive 11 for a print head 1, driven by a pulley rope system 12, can be moved stepwise by a rotary switch 14 present on the operator board 13 where, depending on the direction of rotation, phase-related switch pulses are generated The switch pulses can be evaluated both relative to the direction of rotation and relative to the rotary angle and the rotation speed as well as with the control signals, comparable with the path-dependent measurement device.

The rotary switch 14 can usually be furnished with contact switches with a nap disk comprising a number of contact elements or be made of contactless operating, inductive, capacitive or opto-electronic sensors.

A fine positioning of the position-determining element 6 can be adjusted with an additional key 15 on the operator board 13. At the same time, a programming can be performed of the operating parameters 3 displayed on the permanent or callable display 4.

Figure 3:
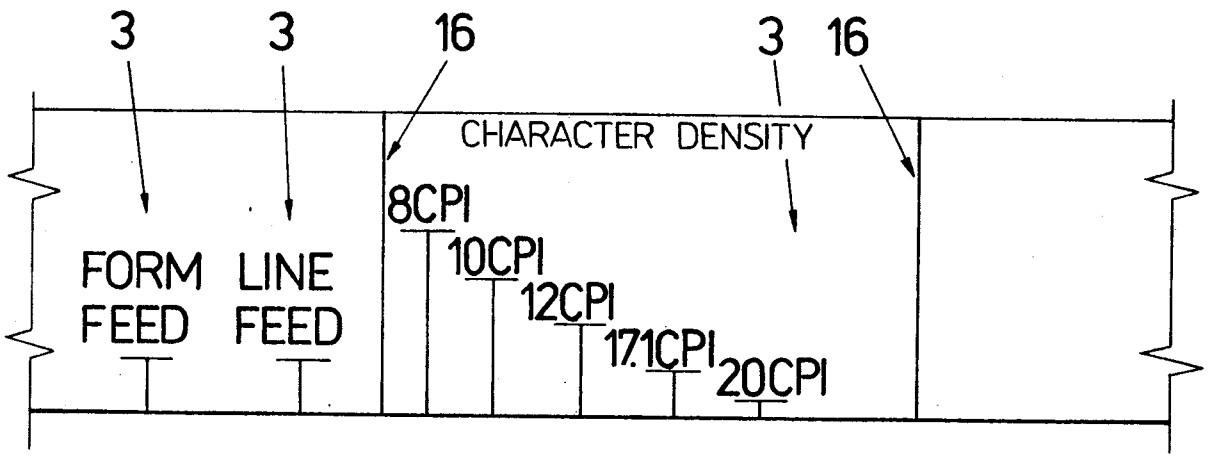
FIG. 3 is a view of a part of a permanent or callable display in actual size.

FIG. 3 illustrates an embodiment for the arrangement of the operating parameters 3. In this case, a display block 16 is formed for the "character density."

An electronic logic 17 is functionally switched between the print-head drive 11 and the operator board 13. The logic 17 comprises a microprocessor, a non-erasable and write-protected function and program memory storage 21, a nonvolatile read/write storage 22 for the actual operating parameters, and a peripheral control unit 23 which controls the print-head drive 11. All elements are connected to each other via a data bus 24 and via an address bus 25.

Figure 7:
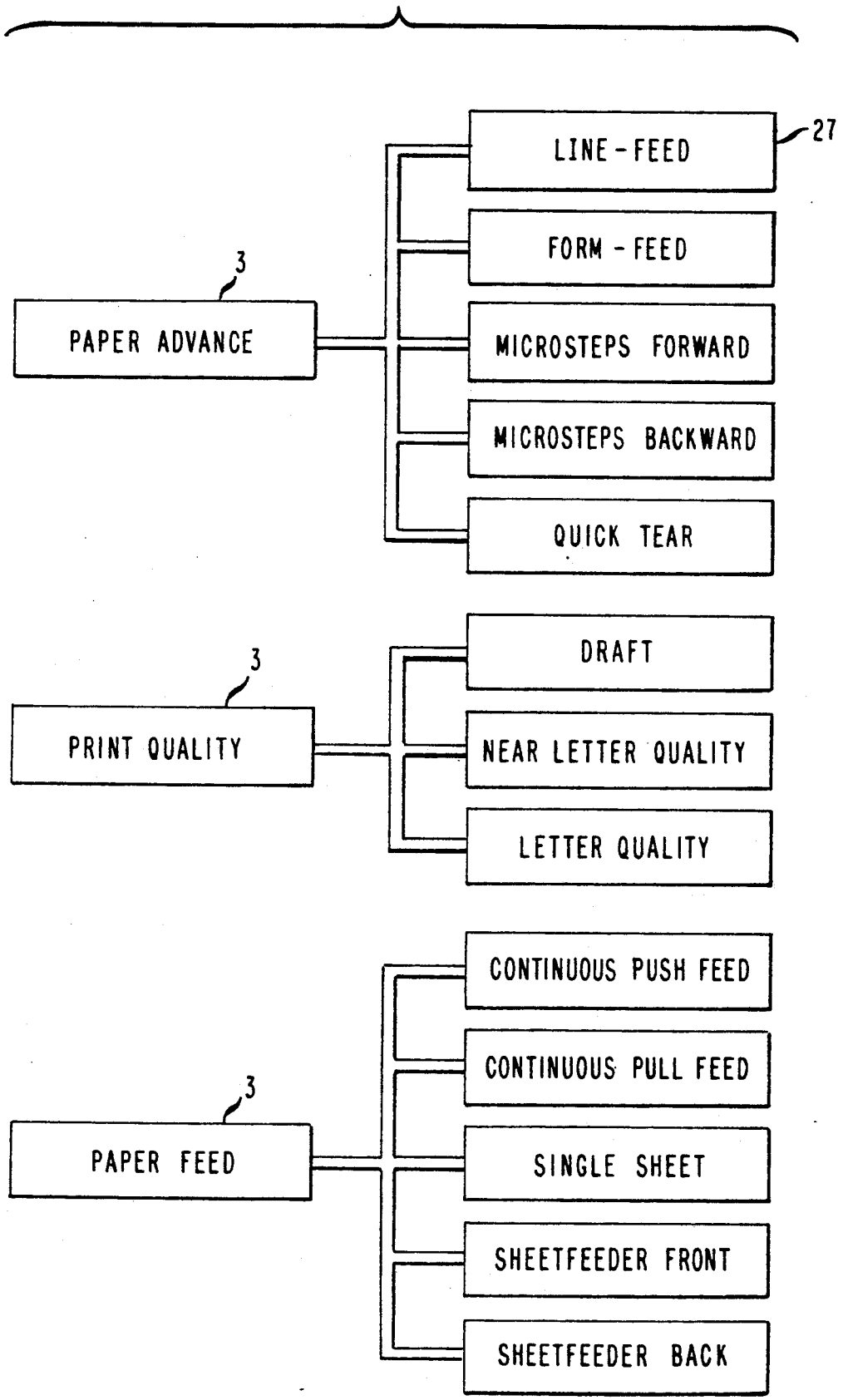
FIG. 7 a view of the display blocks and of the operating parameters.

A coordinating table 27, illustrated in FIG. 7, between all programmable operating parameters and the possible positions of the position indicator 7 of the print head 1, is stored in the non-erasable function memory storage 21. The coordinating table "print head-position-/operating parameter" corresponds to the text-display scale 8 on the printer casing 5.

The control program 26, required for the course of operation, is stored in a non-erasable function and program memory storage 21.

The change of an operating parameter 3 occurs in two steps. According to the first step, the actually valid operating parameter is displayed within a display block 16. In this connection, the print head 1 is controlled by rotation of the rotary switch 14 into the display block 16 to be changed on the text-display scale 8. The rotary switch 14 comprises two digital switches, staggered by a rotary angle. The switching sequences of the digital switches relative to the rotation direction are evaluated by the microprocessor 20. A generated cycle pair of the rotary switch 14 results in a shifting of the print head 1 into a neighboring display block 16. The rotary switch 14 can generate, for example, four cycle pairs per revolution. The logic 17 recognizes the selected display block 16 based on the coordinating table 27 from the non-erasable function and program memory storage 21 and receives the actually valid operating parameter 3 from the nonvolatile write/read storage 22. The nominal set position of the print head 1 for the operating parameter 3 of the coordinating table 27 is generated within the display block 16 of the text-display scale 8. A control program in the microprocessor 20 generates by scanning of the position-determining element 6 the required advance cycles in order to position the print head 1 and the position indicator 7 to the corresponding operating parameter 3 on the text-display scale 8. The advance cycles are transferred from the microprocessor 20 to the peripheral control unit 23 and are converted by the peripheral control unit 23 into advance signals at the print-head drive 11 The operator recognizes the actually valid operating parameter 3 on the text-display scale 8 based on the position indicator 7.

According to a second step, based on a simultaneous actuation of the key 15 and of the rotary switch 14 on the operator board 13, there is achieved within the display block 16 a fine positioning to a new parameter. The cycle pulses of the rotary switch 14 are again evaluated by the microprocessor 20 into directional and cycle pulses, however, only for the operating parameters 3 within the display block 16. Control pulses for the print head motion are generated via the coordinating table 27 (FIG. 7) and are transferred to the peripheral control unit 23. The peripheral control unit 23 activates the print-head drive 11 By releasing of the key 15, a pulse flank is generated which allows the loading of the displayed operating parameter 3 into the nonvolatile write/read memory storage 22. The new operating parameter is thus stored and available.

The process is to be rendered clearer and better understandable by way of the example illustrated in FIG. 3. The operator or user would like to change the character density. According to a first step, the user controls the print head 1, which, advantageously, conventionally assumes its position on the most often used display block, for example, "paper advance," while in rest position (local or off-line), by rotation of the rotary switch 14 to the display block "character density" on the text-display scale 8. The print-head position sets itself automatically to the actual operating parameter, for example, 10 characters per inch, the position indicator 7 displays "10 CPI" on the text-display scale 8. By depressing the key 15, the print head 1 can be moved within the display block 16 toward the right or the left onto the neighboring operating parameters based on a rotation of the rotary switch 14. If it is assumed that the rotary switch 14 generates four cycles per revolution, then, in the example illustrated, the print head 1 is set to the position "17.1 CPI" by rotation of the rotary switch 14 by one-half revolution. By releasing of the key 15, the new character density "17.1 CPI" is stored as the new actual character density.

Figure 2:
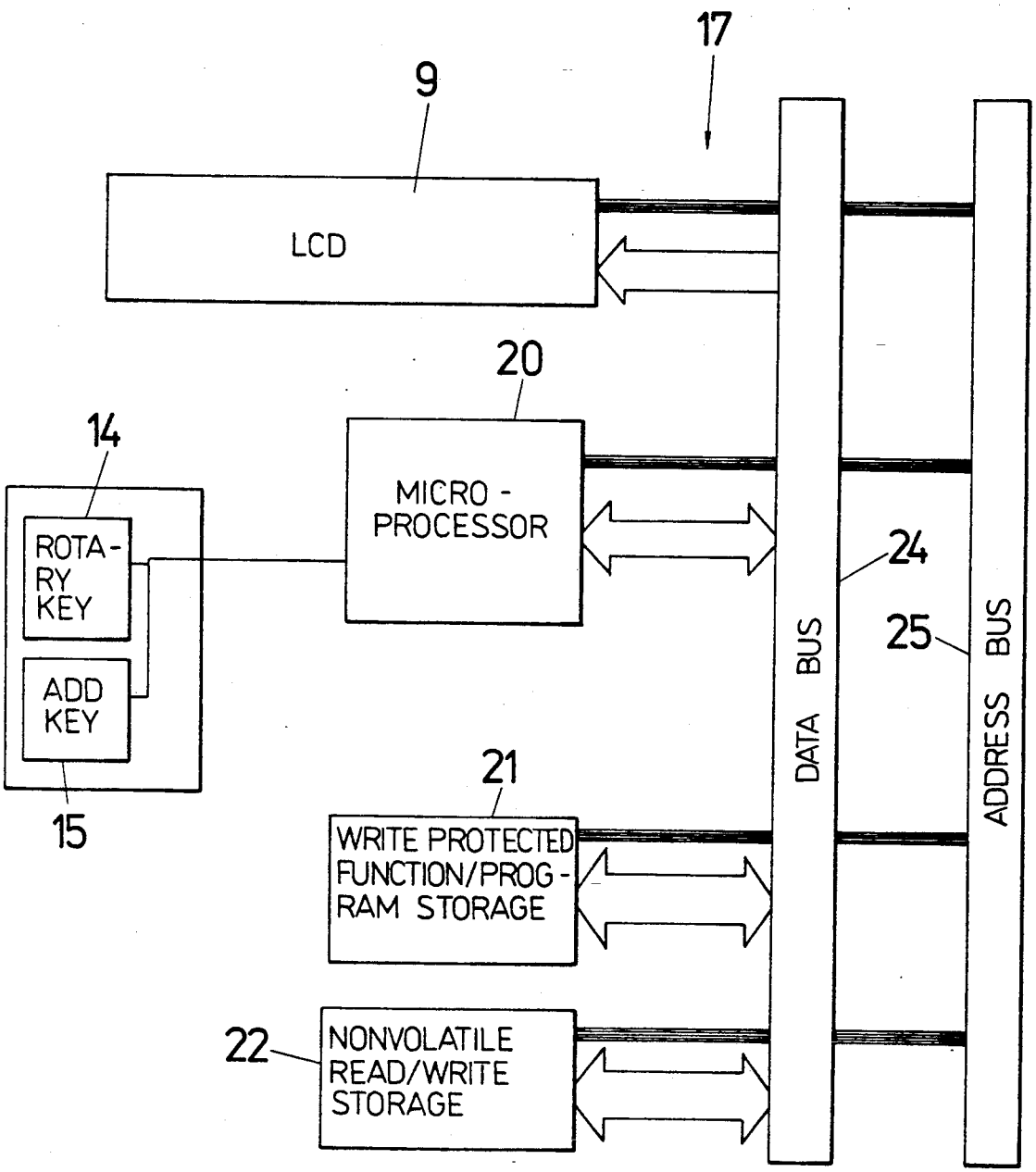
FIG. 2 is a view of a schematic diagram of the arrangement with liquid-crystal display.

A liquid crystal display 9 can be employed instead of the somewhat complicated text-display scale 8, wherein the control of the print head 1 and the text-display scale 8 is imitated on the liquid crystal display 9 (FIG. 2).

According to a further step illustrated in FIG. 5, the display 4 can comprise a text-display scale 8 and indexes 18, which can be shifted or inserted. The rotary switch 14 is eliminated. Instead of a position indicator 7 or of a light dot 10 at the print head, a contactless sensor 28 is employed and adapted, which recognizes the position of the indexes 18. The scanning of the indexes 18 is performed by a motion of the print head 1 over the entire imprintable width. A reprogramming is performed by reinserting the indexes 18 and reinitializing the scanning routine, which is initiated by the key 15.

In the context of the present invention, a visual display can be a text-display scale 8 or a liquid crystal display 9. For the purposes of the present invention, a display can be a permanent display or can be a callable display. The light element on a display can be a passive or can be an active display element. A position device is for the purposes of the present invention either a path-dependent measurement device or a counter device. For the purposes of this document, an action switch can be a contact switch with a nap disk having a plurality of electrical contact positions. For the purposes of this document, a position sensor can be a contactless operating sensor, an inductive sensor, a capacitive sensor or an opto-electronic sensor.

What is claimed as new and desired to be protected by Letters Patent is set forth in the appended claims.

1. A device for a setting of operating parameters of a printer comprising a casing for the printer;

a menu display surrounded by the casing, and means to visually display operating parameters of the printer;

an operator board having release elements, and means to permanently program parameter data by way of said release elements of the operator board;

a print head, movable back and forth over a width of a paper band and means enabling a position of the print head to serve as an index versus parameter data in the menu display recorded parallel to an extension of a print-head motion path; and a position-determining element provided at the print head for delivering a position signal; and means to reproduce on the display a momentary position value representative of the position of the print head.

2. The device according to claim 1, wherein the display is a text-display scale, and wherein the operating parameter is applied in form of indexes coordinated and insertable into the text-display scale, and wherein the print head is furnished with a sensor for recognizing a momentary position of the indexes.

3. The device according to claim 2, wherein the sensor is a position sensor.

4. The device according to claim 1, wherein the display comprises a visual display.

5. The device according to claim 4, wherein the display is represented by an exchangeable text-display scale.

6. The device according to claim 1, wherein a position device serves as a position-determining element, and wherein a position indicator is made of a light element on the display.

7. The device according to claim 1 further comprising a rotary switch disposed on the operator board;

a print-head drive controllable via the rotary switch, where said rotary switch generates phase-related switching pulses depending on a rotation direction, wherein the phase-related switching pulses are evaluated both with respect to a rotation direction as well as with respect to the rotary angle and a rotation speed.

8. The device according to claim 7, wherein the rotary switch is formed by an action switch.

9. The device according to claim 1, wherein a fine positioning means for the position-determining element is adjustable by way of an additional key on the operator board, and wherein simultaneously a programming can be performed of the operating parameters displayed on the display.

10. The device according to claim 1, wherein the printer is a matrix printer.

11. A device for a setting of operating parameters of a printer, comprising a casing;

a visual display;

a print head having a momentary position indicator including means for moving said indicator back and forth over a width of a paper band, the position of the print head serving as an index versus parameter data in the visual display recorded parallel to an extension of a print-head motion path;

an operator board;

release elements mounted on the operator board wherein the parameter data are in each case permanently programmable by way of said release elements of the operator board and, wherein the operating parameters (3) are visibly displayed on the visual display (4) on the casing (5) of the printer;

a position-determining element (6) provided at the print head (1);

means reproducing a representation of the position of the momentary position indicator (7) of the print head on the visual display (4) representing the operating parameter (3).

12. The device according to claim 11, wherein the operating parameter (3) is applied in form of indexes (18), coordinated and insertable in a text-display scale (8) on the visual display, and wherein the print head (1) is furnished with a sensor (28) for recognizing the momentary position of the indexes.

13. The device according to claim 12, wherein the sensor (28) is a position sensor.

14. The device according to claim 11, wherein the display (4) comprises a visual display.

15. The device according to claim 14, wherein the display is represented by an exchangeable text-display scale (8).

16. The device according to claim 11, wherein a position device serves as the position-determining element (6), and wherein the position indicator (7) is made of a light element on the display (4).

17. The device according to claim 11, wherein a print-head drive (11) is controllable via a rotary switch (14), disposed on the operator board (13), where said rotary switch (14) generates phase-related switching pulses depending on the rotation direction, wherein the phase-related switching pulses are evaluated both with respect to a rotation direction as well as with respect to a rotary angle and a rotation speed.

18. The device according to claim 17, wherein the rotary switch (14) is formed by an action switch.

19. The device according to claim 11, wherein a fine positioning of the position-determining element (6) is adjustable by way of an additional key (15) on the operator board (13), and wherein simultaneously a programming can be performed of the operating parameters (3) displayed on the display (4).

20. The device according to claim 11, wherein the printer is a matrix printer.

* * * * *